US005906369A

United States Patent [19]

Brennan et al.

[11] Patent Number: 5,906,369

[45] Date of Patent: May 25, 1999

[54] ELECTRONIC MATCHING GAME APPARATUS INCLUDING SOUND GENERATING MEANS AND METHOD OF GAME PLAY USING THE SAME

[75] Inventors: William H. Brennan, Long Meadow; Lucinda I. Tavernise, Granville, both of Mass.; Frederic W. Stucklen, East Windsor, Conn.; Robert H. Beck, Maple Grove; Michael Marra, Chanhassen, both of Minn.

[73] Assignee: Hasbro, Inc., Pawtucket, R.I.

[21] Appl. No.: 08/882,315

[22] Filed: Jun. 25, 1997

[51] Int. Cl.[6] ..... A63F 9/24

[52] U.S. Cl. ..... 273/238; 273/273; 434/335; 434/340; 434/343; 434/308

[58] Field of Search ..... 273/238, 237, 273/273, 455, 454; 463/9; 434/335, 340, 343, 308

[56] References Cited

U.S. PATENT DOCUMENTS

| | | | |
|---|---|---|---|
| 3,729,198 | 4/1973 | Shaffer . | |
| 4,348,191 | 9/1982 | Lipsitz et al. | 434/308 |
| 4,385,762 | 5/1983 | Schwartz | 273/237 |
| 4,524,967 | 6/1985 | Hanson et al. | 273/273 |
| 4,526,550 | 7/1985 | Lurito | 434/340 |
| 4,969,650 | 11/1990 | Magara et al. | 273/238 |
| 4,993,983 | 2/1991 | Kurita et al. | 446/94 |
| 5,120,065 | 6/1992 | Driscoll et al. | 273/237 |
| 5,277,429 | 1/1994 | Smith, III | 273/237 |
| 5,290,038 | 3/1994 | Khin | 273/263 |
| 5,411,271 | 5/1995 | Mirando | 273/434 |
| 5,460,381 | 10/1995 | Smith et al. | 273/238 |

*Primary Examiner*—Benjamin H. Layno
*Attorney, Agent, or Firm*—Kurt Benson

[57] ABSTRACT

An electronic matching game includes a plurality of primary game pieces each representative of a mother farm animal, a plurality of secondary game pieces each representative of a baby farm animal associated with one of mother farm animals, and a plurality of removable cover members for selectively concealing the identity of each of the secondary game pieces. The apparatus further includes a base assembly having a first receptacle adapted to interchangeably receive one of the primary game pieces, and further having a second receptacle adapted to interchangeably receive one of the secondary game pieces. The base assembly includes an electronic sound generation device for producing a plurality of sounds, each sound being associated with a respective one of the primary and secondary game pieces. Each of the receptacles includes a plurality of switches coupled to the sound generating device for causing the sound generating device to produce a respective sound corresponding to a respective game piece placed on the respective receptacle. Each of the game pieces includes selectively located projections for selectively engaging selected switches which correspond to the respective sound for the game piece. In a method of game play, game play proceeds by selecting and placing one of the primary game pieces, i.e. mother farm animals, into a receptacle on the base assembly wherein the base assembly generates a first sound corresponding to the respective mother farm animal, randomly selecting one of the concealed secondary game pieces, i.e. baby farm animals, and placing the baby farm animal game piece into a receptacle on the base assembly wherein the base assembly generates a sound corresponding to the baby farm animal. The object of the game is to match the concealed baby animals to the mother animal by matching the sounds of each of the game pieces.

18 Claims, 11 Drawing Sheets

ELECTRONIC MATCHING GAME APPARATUS INCLUDING SOUND GENERATING MEANS AND METHOD OF GAME PLAY USING THE SAME

BACKGROUND AND SUMMARY OF THE INVENTION

The instant invention relates to children's board games, and more particularly to an electronic matching game for teaching memory skills to young children. The game apparatus and method of game play are based on a farm theme which requires the players to match sounds produced by disguised game pieces when the game pieces are placed in receptacles on a base assembly resembling a barn ramp.

Electronic game apparatus which produce sounds or other signals when game pieces are placed in selected locations on game boards have heretofore been known in the art. In this regard, the U.S. Pat. No. 4,385,762 to Schwartz, Lurito U.S. Pat. No. 4,526,550, Magara U.S. Pat. No. 4,969,650 and Kurita et al U.S. Pat. No. 4,993,983 represent the closest prior art to the subject matter of the present invention of which the applicant is aware. The patents to Schwartz and Lurito each disclose an electronic matching game including a base with a plurality of differently shaped receptacles formed therein, and a plurality of game pieces having complementary shapes. The receptacles have switches in their interior which are connected to a sound generating means. When the correct game piece is inserted into the corresponding receptacle on the base, the switch is closed and a sound is generated. The patent to Magara discloses a board game wherein game pieces are provided with a plurality of bumps on the bottom surface thereof. The game board has a plurality of receptacles, each having a plurality of switches. The electronic circuitry of the board can determine the identity of the game piece by the arrangement of bumps on the game piece which selectively close various ones of the switches when placed in the receptacles. In a strategy game utilizing this apparatus, the identity, or rank, of opposing player's game pieces can be determined without revealing the identity, or rank, of the game pieces to the other player during game play. The patent to Kurita discloses a toy vehicle having a chassis and a plurality of body shells. The chassis includes a plurality of switches which cooperate with sound generating circuitry to produce different siren sounds. The body shells include different arrangements of bumps which actuate the switches when mounted on the chassis. The bumps on the body shell are arranged to actuate the switches that correspond to the siren for that body shell. For example, an ambulance body shell includes an arrangement of bumps which will actuate the proper switches for producing an ambulance siren sound. While the above-noted apparatus are effective for their intended purposes, there is always a continuing need and consumer desire for new and amusing toys.

The instant invention provides an electronic matching game wherein the object of the game is to match game pieces to each other by matching the sounds produced by each game piece when the game pieces are inserted into a receptacle on a game base. More specifically, the electronic matching game includes a plurality of primary game pieces each representative of a mother farm animal, a plurality of secondary game pieces each representative of a baby farm animal which is associated with a respective one of mother farm animals, and a plurality of removable cover members for selectively disguising or concealing the identity of each of the secondary game pieces. The apparatus further includes a base assembly in the shape of a barn ramp having a first receptacle adapted to interchangeably receive one of the primary game pieces, and further having a second receptacle adapted to interchangeably receive one of the secondary game pieces. The base assembly further includes an electronic sound generation device for producing a plurality of different sounds, each sound being associated with a respective one of the primary and secondary game pieces. For example, one associated pair of the primary and secondary game pieces comprises a mother cow and a baby cow wherein there is a corresponding mother cow sound for the mother cow and a baby cow sound for the baby cow. Each of the receptacles includes a plurality of switches coupled to the sound generating device for causing the sound generating device to produce a respective sound corresponding to a respective game piece placed on the respective receptacle. Each of the game pieces includes a selectively located projection or projections for selectively engaging selected switches which correspond to the respective sound for the game piece. Accordingly, the mother cow game piece includes a projection or projections for actuating the switch or switches for the mother cow sound.

In a method of game play, the identity of each of the secondary game pieces, i.e. the baby farm animals, is concealed by placing the removable covers over the game pieces. In the preferred embodiment, the baby farm animals are mounted on bases, and the removable cover members comprise hollow cups resembling haystacks which are removably mounted onto the bases. Game play proceeds by selecting and placing one of the primary game pieces, i.e. one of the mother farm animals, into the mother farm animal receptacle on the base assembly wherein the base assembly generates the sound corresponding to the mother farm animal, randomly selecting one of the concealed secondary game pieces, i.e. baby farm animals, and placing the baby farm animal game piece into the baby farm animal receptacle on the base assembly wherein the base assembly generates a sound corresponding to the baby farm animal. The object of the game is to match the concealed baby animals to the mother animals by matching the sounds of each of the game pieces. The game can also include multiple baby animals which must be matched the mother animals. By increasing the number of baby animals to match, the difficulty of the game is increased making the game playable by older children as well.

Accordingly, among the objects of the instant invention are: the provision of an electronic matching game wherein the object of the game is to match game pieces to each other by matching the sounds produced by each game piece when the game pieces are inserted into a receptacle on a game base; the provision of an electronic matching game including a plurality of primary game pieces, a plurality of associated secondary game pieces, and means for selectively concealing the identity of the secondary game pieces, wherein the object of the game is to match the concealed secondary game pieces to the visible primary game pieces by matching the sounds of each piece; the provision of such a game wherein the primary game pieces are representative of mother farm animals and the secondary game pieces are representative of baby farm animals; the provision of such a game apparatus further including a base assembly including a sound generating device wherein the base assembly and sound generating device are adapted to generate sounds corresponding to the game pieces when the game pieces are inserted into receptacles on the base assembly; and the provision of a method of game play utilizing the game apparatus of the invention.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
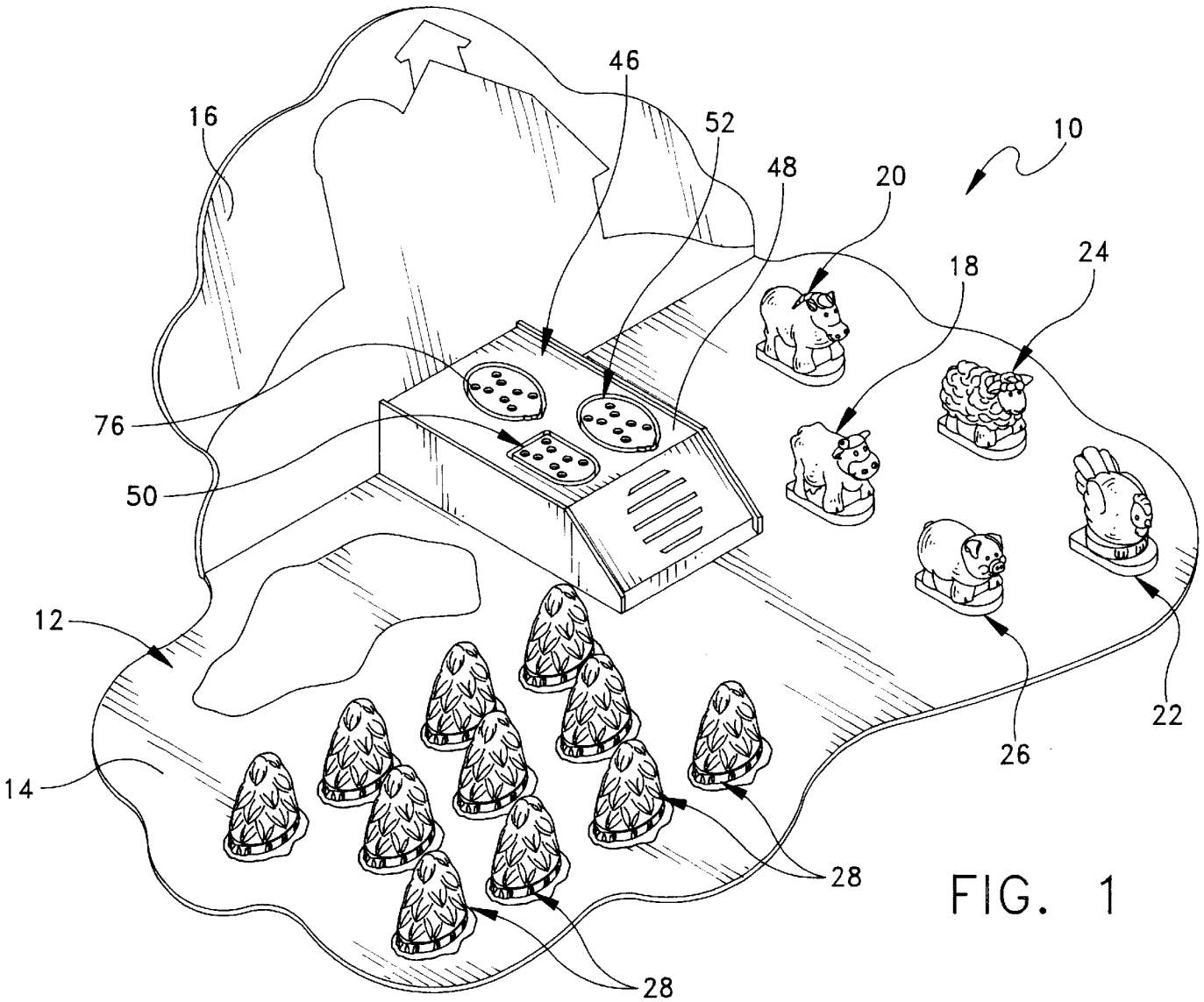
FIG. 1 is a perspective view of the game apparatus of the present invention.
Figure 2:
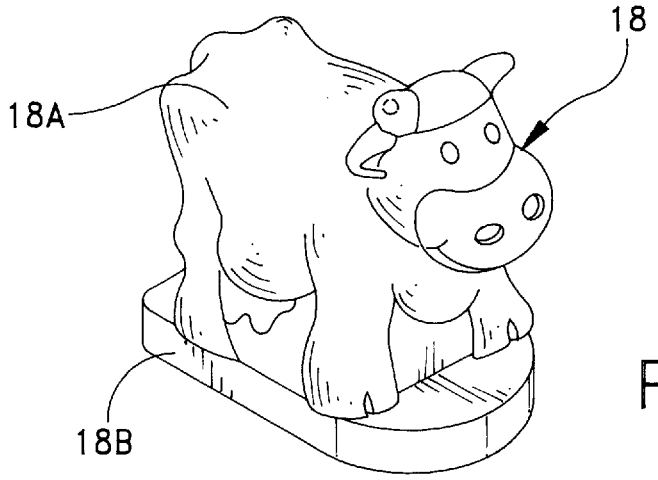
FIGS. 2–6 are perspective views of each of the mother animal game pieces of the game apparatus.
Figure 3:
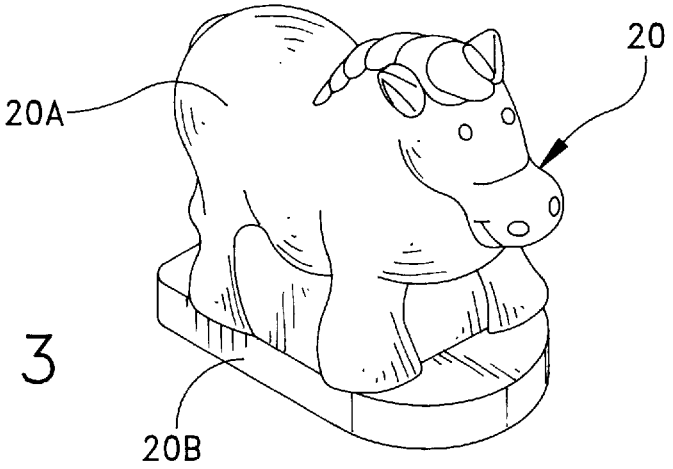
Figure 4:
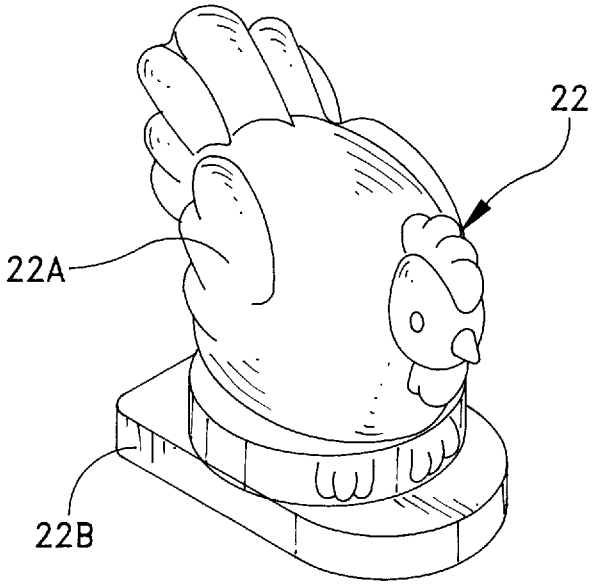
Figure 5:
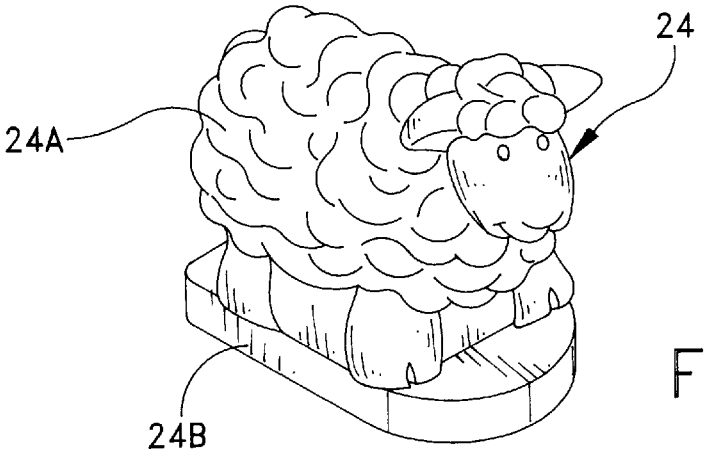
Figure 6:
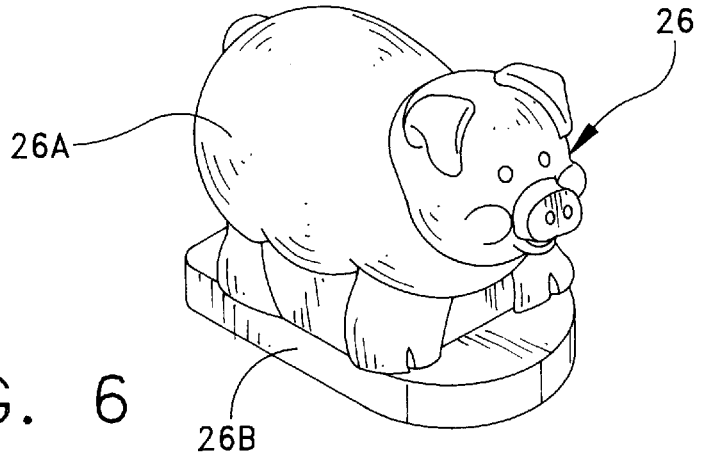
Figure 7:
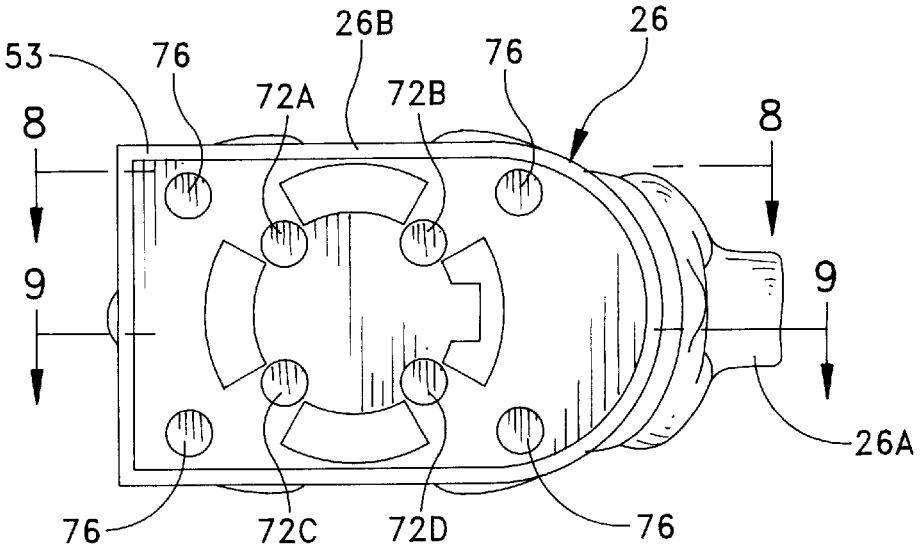
FIG. 7 is a bottom view of one of the mother pig game piece.
Figure 8:
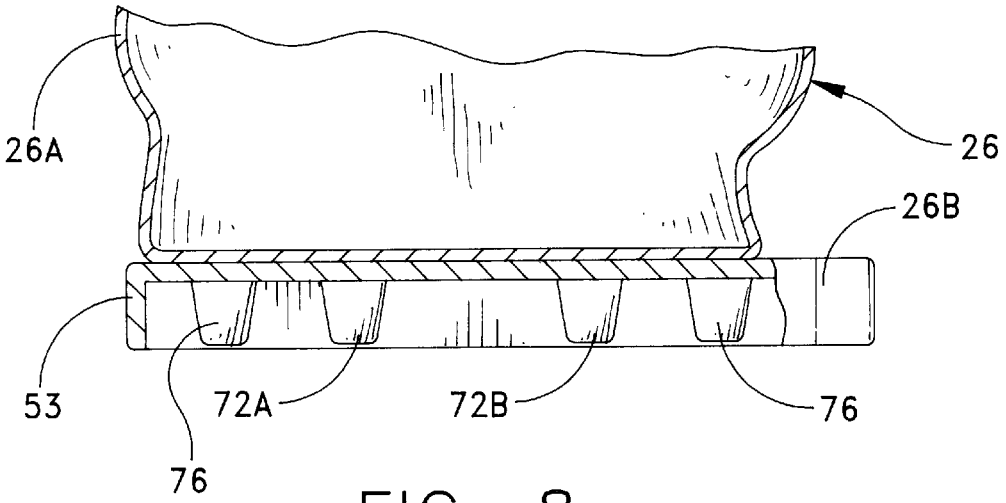
FIG. 8 is a cross-sectional view thereof taken along line 8—8 of FIG. 7.
Figure 9:
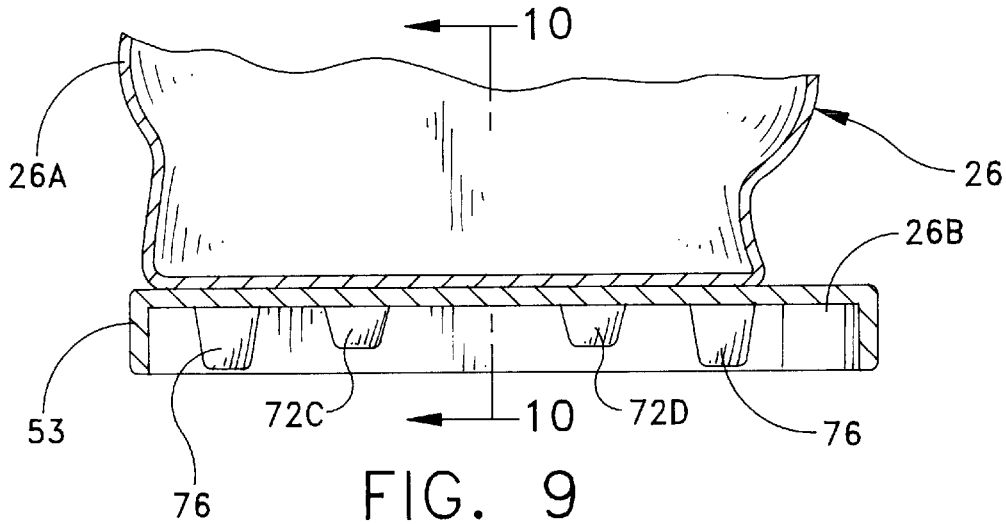
FIG. 9 is another cross-sectional view thereof taken along line 9—9 of FIG. 7.
Figure 10:
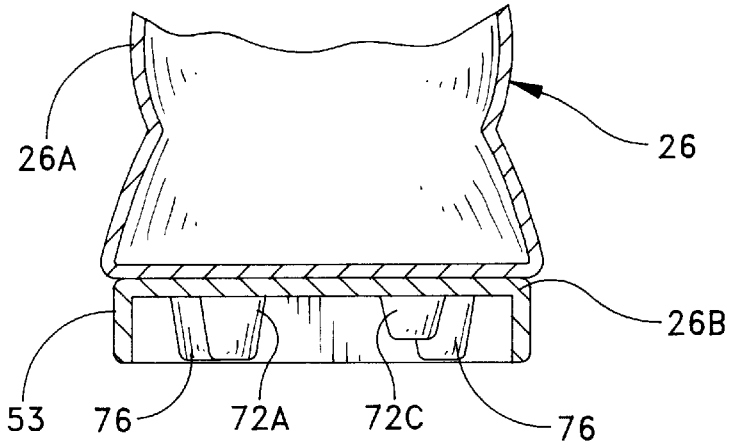
FIG. 10 is yet another cross-sectional view thereof taken along line 10—10 of FIG. 9.

Referring now to the drawings, the electronic matching game apparatus of the instant invention is illustrated and generally indicated at 10 in FIG. 1. As will hereinafter be more fully described, the instant game apparatus 10 is utilized in a child's game wherein the object of the game is to match different game pieces to each other by matching the sounds produced by each game piece when the game pieces are inserted into a receptacle on a game base.

Referring to FIG. 1, the game 10 includes a game board generally indicated at 12 having a first horizontal portion 14 and a second vertical portion 16 each including fanciful illustration of farm scenery thereon. The game board portions 14, 16 are preferably formed from a rigid paperboard material and are sized so as to fit within a reasonably sized game box.

Referring to FIGS. 1–6, the electronic matching game 10 further includes a plurality of primary game pieces generally indicated at 18, 20, 22, 24 and 26 each representative of a mother farm animal. More specifically, primary game piece 18 (FIG. 2) is representative of a mother cow, primary game piece 20 (FIG. 3) is representative of a mother horse, primary game piece 22 (FIG. 4) is representative of a mother chicken, primary game piece 24 (FIG. 5) is representative of a mother sheep, and primary game piece 26 (FIG. 6) is representative of mother pig. Each of the game pieces 18, 20, 22, 24 and 26 includes a respective body portion A (i.e. 18A, etc.), and a respective base portion B for supporting the piece on a supporting surface.

Figure 11:
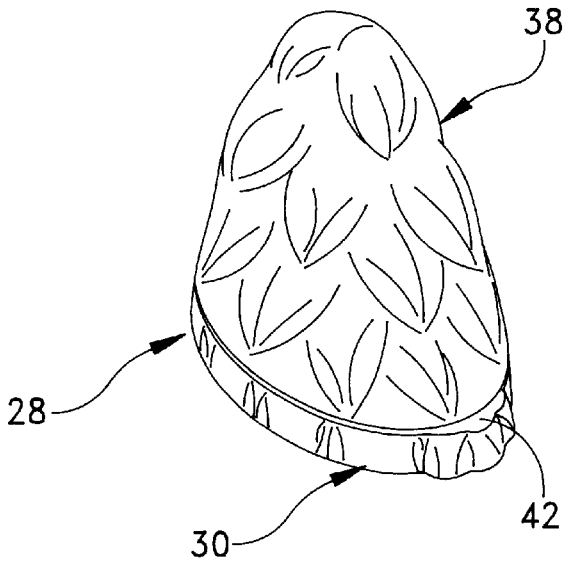
FIG. 11 is a perspective view of one of the baby animal game piece of the game apparatus.
Figure 12:
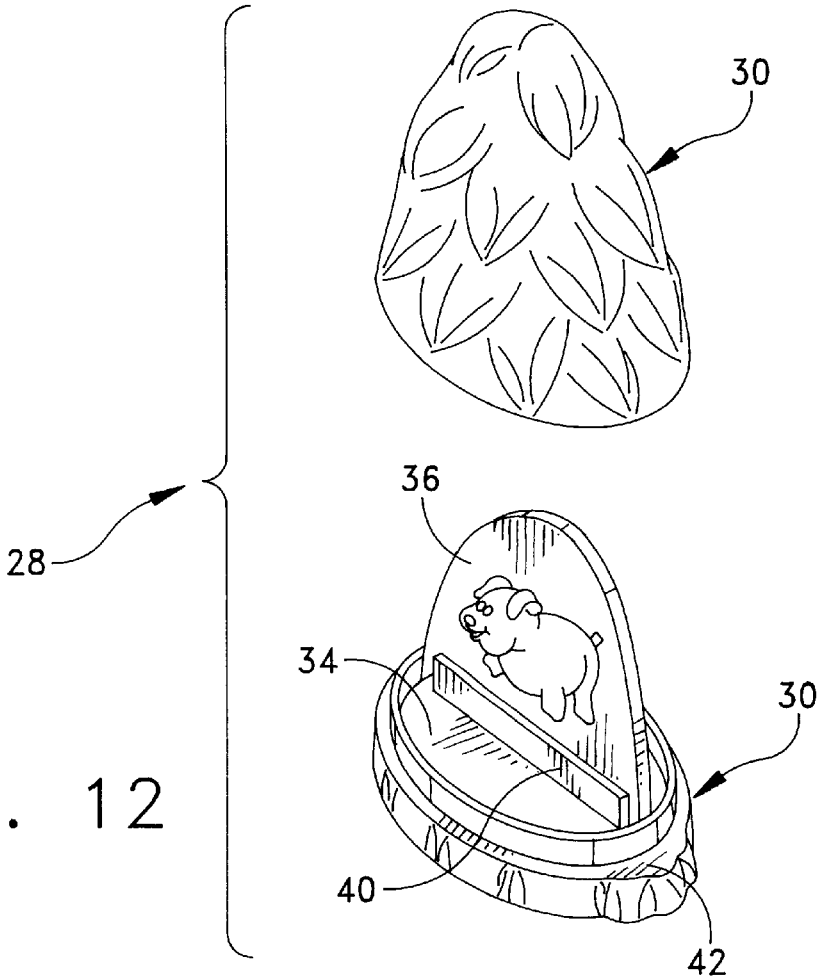
FIG. 12 is an exploded perspective view thereof.

Referring now to FIGS. 1, 11, and 12, the game apparatus 10 still further includes a plurality of secondary game pieces, each generally indicated at 28, and each representative of a baby farm animal which is associated with a respective one of mother farm animal game pieces 18, 20, 22, 24 and 26. In the preferred game apparatus as illustrated, there are two matching baby farm animals for each of the mother farm animals. The secondary game pieces 28 each comprise a respective base portion generally indicated at 30 having a bottom surface 32 and an upper surface 34, a card member 36 mounted to the upper surface 34 of the base portion 30, and a cover portion generally indicated at 38 removably received on the base portion 30 for selectively concealing the identity of the secondary game piece 22 during game play. The upper surface 34 of the base portion 30 includes two spaced ridges 40 between which the card member 36 is received with a friction fit. The card member 36 is provided with a fanciful illustration of the respective baby farm animal which the game piece 22 is intended to represent. It is contemplated that the base 30 could be molded with the baby farm animal representation as an integral portion thereof. The base portion 30 includes a circumferential shoulder 42 for removably receiving a rim 44 of the cover portion 38 in assembled relation. The outer surfaces of the base portion 30 and the cover portion 38 are preferably provided with contouring and color which is representative of a haystack so that it appears that each of the baby farm animals is hiding beneath a haystack on a farm. For ease of illustration, the detailed construction of only one of the baby farm animal game pieces 28 has been illustrated in FIGS. 11 and 12, it being understood that all of other secondary game pieces 28 have an identical construction with the exception of the illustrations on the respective card members 36 thereof.

The game apparatus 10 still further includes a base assembly generally indicated at 46 having a body portion 48 in the shape of a barn ramp. The base assembly 46 has a first receptacle generally indicated at 50 in an upper surface thereof adapted to interchangeably receive one of the primary game pieces 18–26, and further has a second receptacle generally indicated at 52 in the upper surface thereof adapted to interchangeably receive one of the secondary game pieces 28. In this regard, it is pointed out that the base portions 18B–26B of the primary game pieces have a door-shaped rim 53 and the first receptacle 50 has a complementary groove 54 which is adapted to receive the bases 18A–26B in mating relation. The base portions 30 of the secondary game pieces 28 have a generally oval shaped rim 55, and the second receptacle 52 has a complementary groove 56 which is adapted to receive the bases 30 in mating relation. The base assembly 46 further includes a electronic sound generation circuitry generally indicated at 58 which is operative for producing a plurality of different sounds, each sound being associated with a respective one of the primary and secondary game pieces. For example, one associated pair of the primary and secondary game pieces comprises a mother cow and a baby cow wherein there is a corresponding mother cow sound for the mother cow and a baby cow sound for the baby cow. The sound generation circuitry 58 is mounted on a conventional printed circuit board generally indicated at 60 which is mounted within the interior of the body portion 48 of the base assembly 46. In operation, power is provided to the circuit board 60 and circuitry by batteries (not shown). Output signals produced by the sound generation circuitry 58 are output to a speaker 62 via wires 64 wherein the speaker 62 translates the output signals into sounds which can be heard by the users of the game apparatus. The general and specific technologies relating to electronic sound generation circuitry 58, and the software required to run such devices, are well known to those skilled in the electronic and software arts, and therefore the specific details of the digital processing and memory portions of such circuity, and the specific details of any software required for this specific application will not be described further herein.

Each of the receptacles 50, 52 includes a plurality of switches which are coupled to the sound generating circuitry 58 for causing the sound generating circuitry 58 to produce a respective sound corresponding to a respective game piece placed on the respective receptacle. More specifically, each of the receptacles 50, 52 is provided with four switches 62 on the circuit board 60 directly beneath four central openings 64 in the receptacles 50, 52. An elastomeric actuator pad generally indicated at 66 with individual push pads 68 is disposed between the upper surface of the base 46 and the switches 62 on the circuit board. The push pads 68 extend upwardly through the openings 64. The elastomeric actuator pad 66 maintains the push pads 68 in a normally extended position. Conductive pad elements 70 on the bottom of the central four push pads 68 close the switches when the push pads 68 are pressed downwardly into contact with the switches 62.

Figure 13:
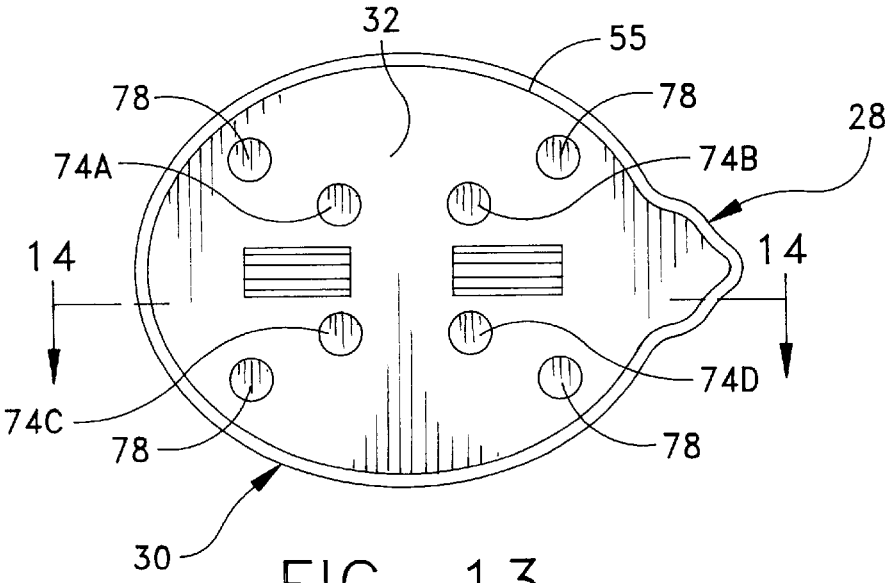
FIG. 13 is a bottom view thereof.
Figure 14:
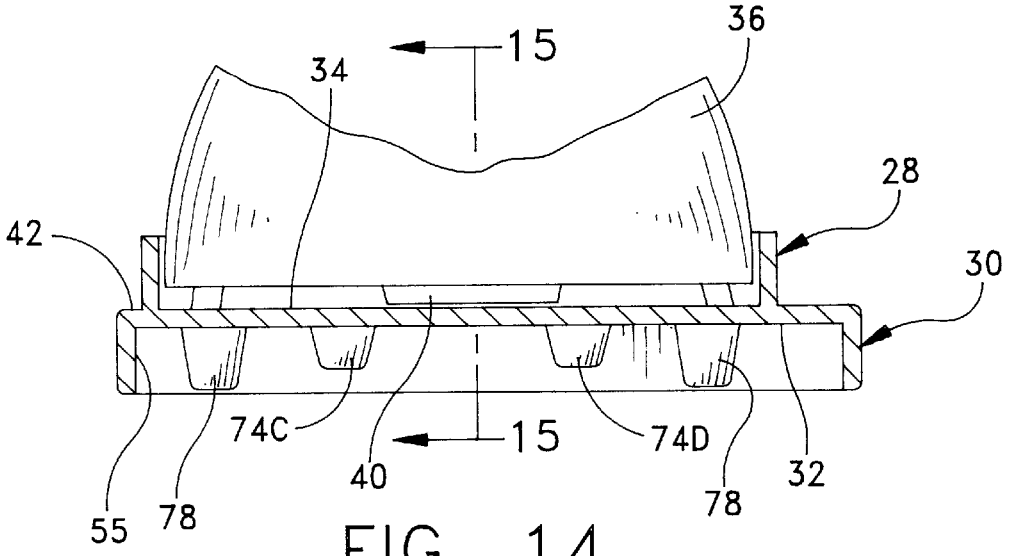
FIG. 14 is a cross-sectional view thereof taken along line 14—14 of FIG. 13.
Figure 15:
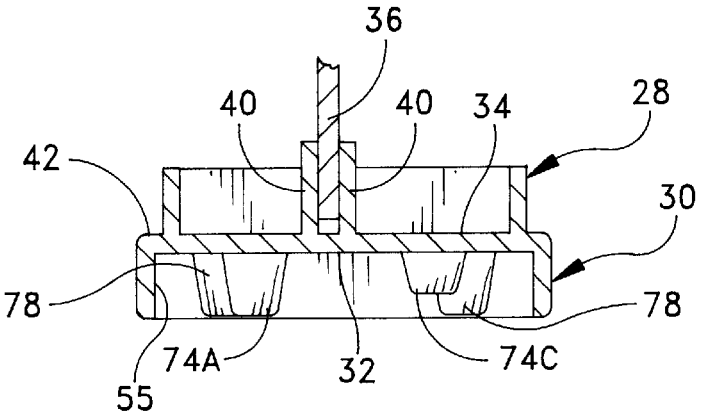
FIG. 15 is another cross-sectional view thereof taken along line 15—15 of FIG. 14.
Figure 16:
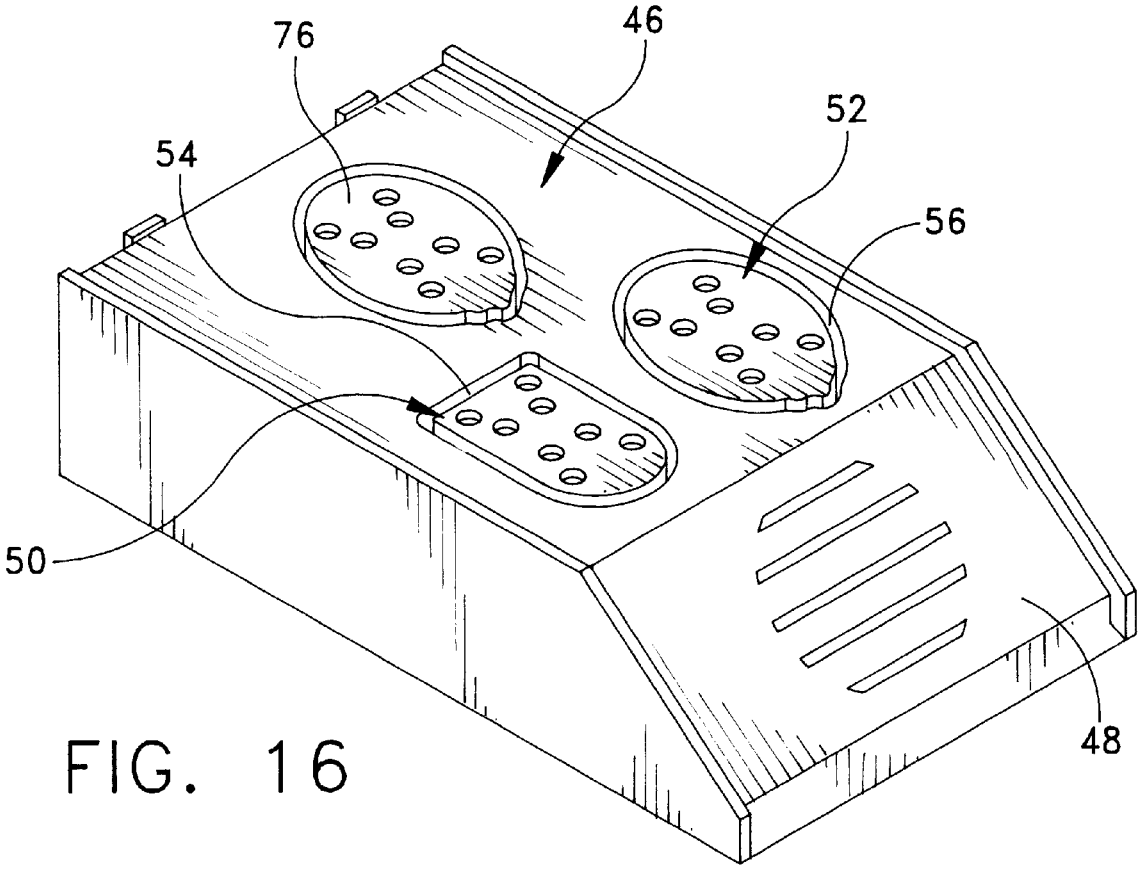
FIG. 16 is a perspective view of the base assembly of the game apparatus.
Figure 17:
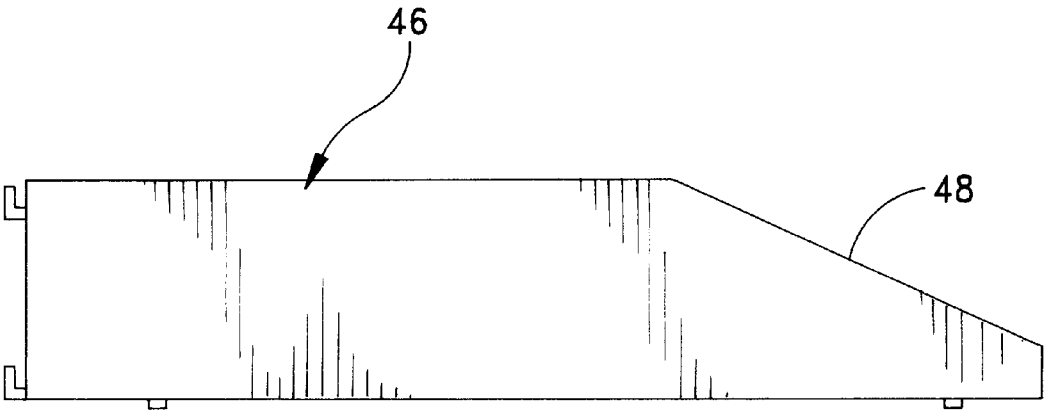
FIG. 17 is a side view thereof.
Figure 18:
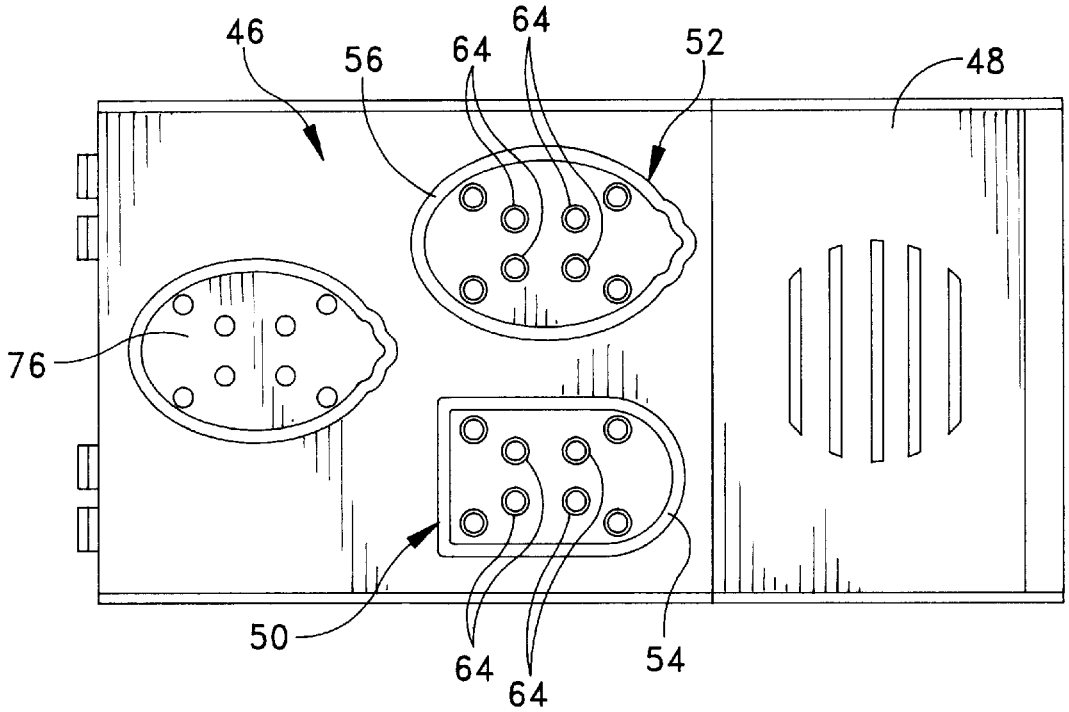
FIG. 18 is a top view thereof.
Figure 19:
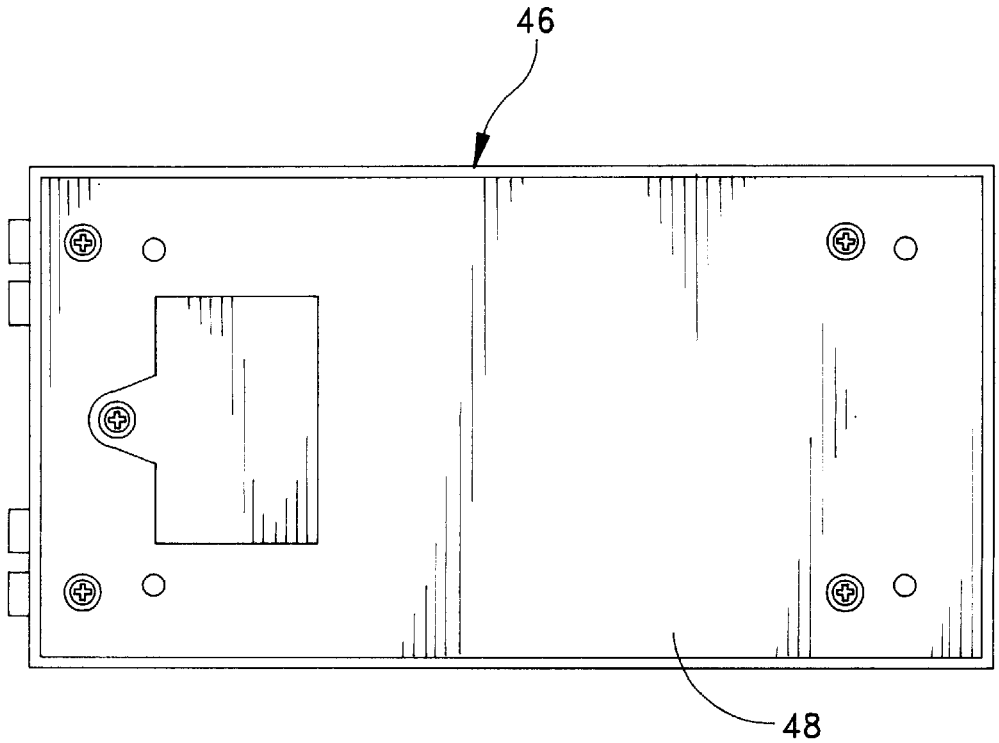
FIG. 19 is a bottom view thereof.
Figure 20:
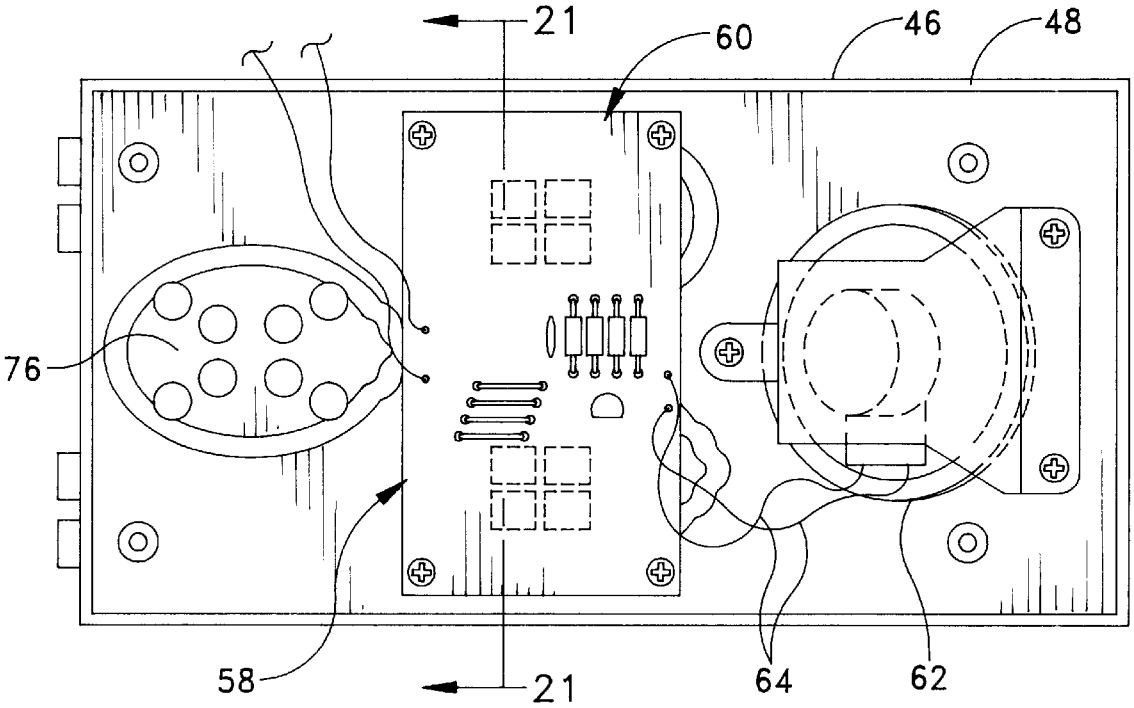
FIG. 20 is another bottom view thereof with the cover plate removed for purposes of illustrating the inner components of the base assembly.
Figure 21:
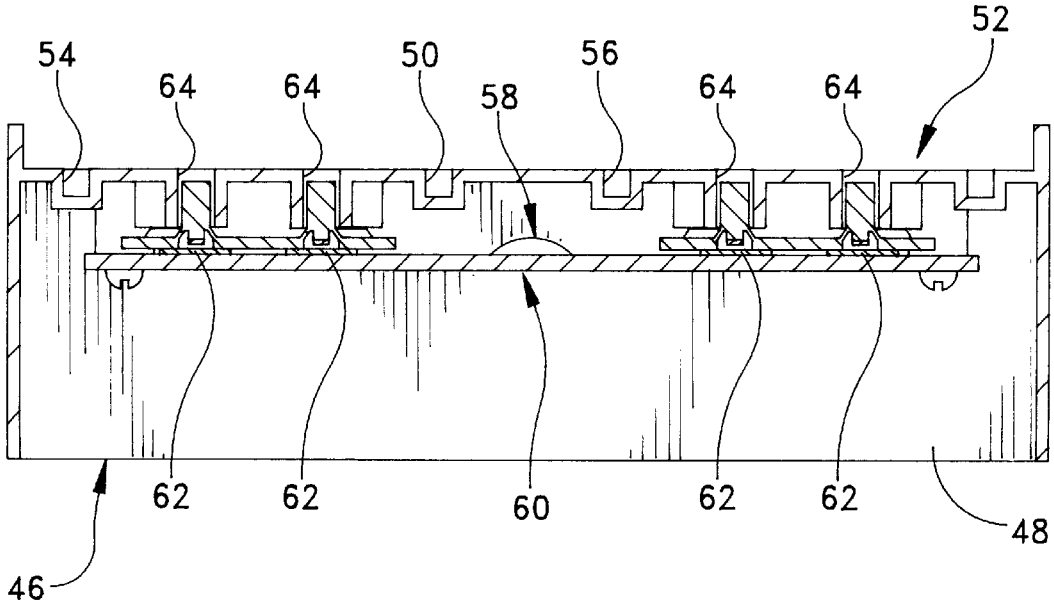
FIG. 21 is a cross-sectional view thereof taken along line 21—21 of FIG. 20.
Figure 22:
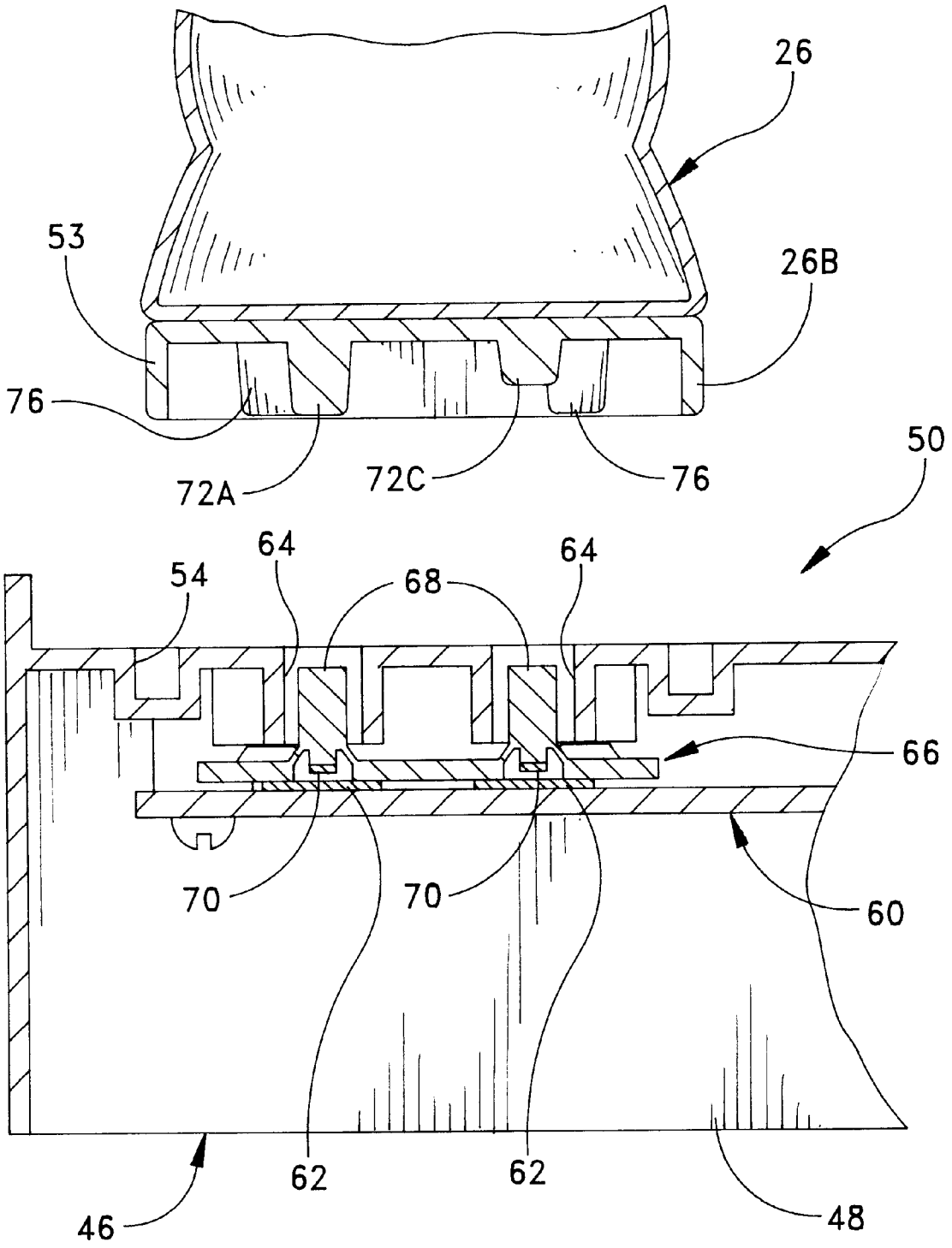
FIG. 22 is an enlarged fragmentary cross-sectional view showing placement of one of the mother animal game pieces on the mother animal receptacle on the base assembly.
Figure 23:
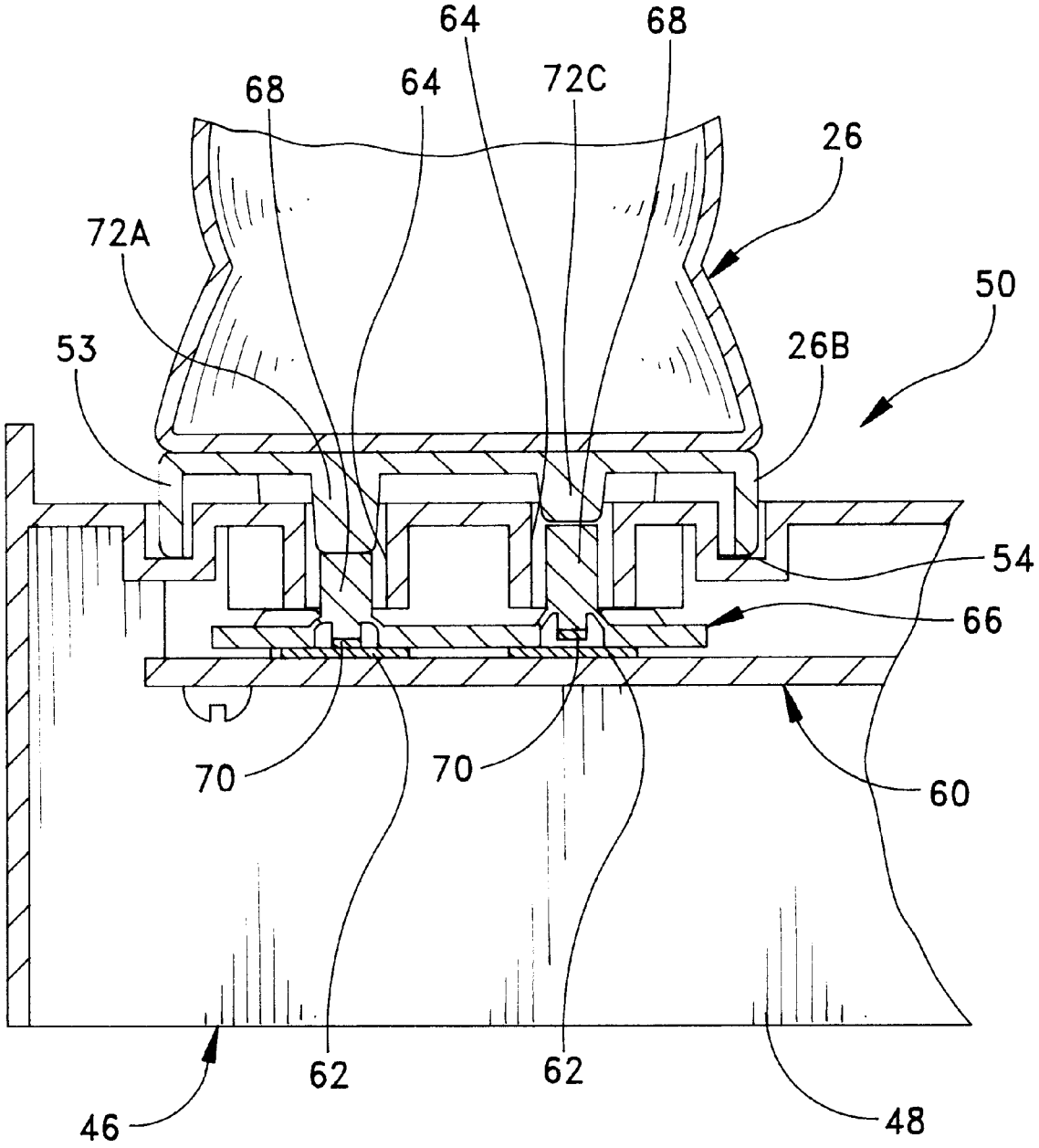
FIG. 23 is a similar view showing the mother animal game piece being fully depressed to close the respective switches of the mother animal receptacle.

Referring to FIGS. 7–10 relative to the primary game pieces 18–26, the base portions 18B–26B of each of the game pieces include selectively located projections 72 for selectively engaging selected switches 62 which correspond to the respective sound for that game piece. The specific arrangement of projections 72 for the mother pig game piece 26 is illustrated in FIGS. 7–10. Likewise referring to FIGS. 13–15 relative to the secondary game pieces 28, the base portions 30 thereof also each include selectively located projections 74 for selectively engaging selected switches 62 which correspond to the respective sound for that game piece 28. The specific arrangement of projections 74 for the baby pig 22 is illustrated in FIGS. 13–15. In connection with the operation of these specific embodiments, only the four center projections 72, 74 are utilized for actuation of the switches 62 while the four outer projections 76 are utilized for alignment of the game pieces onto the receptacle 50, 52. To achieve the output of five different sounds, corresponding to the five different types of animals, from only four switches, selected pairs of the switches 62 are utilized. Referring specifically to FIGS. 7–10, the projections 72 on the bottom of the mother pig game piece are illustrated. It is pointed out that switch projections 72A, 72B are longer than projections 72C, 72D. When the mother pig game piece 26 is aligned on the receptacle 50 (FIG. 22), and is pressed downwardly in the receptacle 50 (FIG. 23), this pair of projections 72A, 72B engages the push pads 68, presses the conductive pads 70 into engagement with the switches 62 there below, and closes the switches 62 to cause the sound generating circuitry 58 to generate the mother pig sound.

Referring to FIGS. 13–15, it can be seen that the base 30 of the baby pig game piece 22 has a like arrangement of projections 74 for engaging the switches 62 beneath the baby animal receptacle 52. Although not illustrated in detail, the operation of the receptacle 52 and secondary game pieces 28 is identical to that of the primary game pieces 18–26, with the exception that respective baby farm animal sounds are generated from the sound generating circuitry 58 when the secondary game pieces 28 are inserted into the receptacle 52. Furthermore, although the baby pig projections 74 are arranged in a like formation to that of the mother pig, it is to be understood that this is only the preferred embodiment and that other arrangements of the projections on the baby farm animals is entirely possible provided, however, that the arrangement of projections and switches is operative for generating the matching sound.

In a method of game play utilizing the above-described electronic game apparatus 10, the identity of each of the secondary game pieces 28, i.e. the baby farm animals, is concealed by placing the removable covers 38 over the game pieces 28. Game play proceeds with one of the players selecting and placing one of the primary game pieces 18–26, i.e. one of the mother farm animals, into the mother farm animal receptacle 50 on the base assembly 46 wherein the sound generation circuitry 58 generates the sound corresponding to the mother farm animal. The next step is for the player to randomly selecting one of the concealed secondary game pieces 28, i.e. baby farm animals, and place the baby farm animal game piece 28 into the baby farm animal receptacle 52 on the base assembly 46 wherein the sound generation circuitry 58 generates a sound corresponding to the baby farm animal. The object of the game is to match the concealed baby animals 28 to the respective mother animals 18–26 by matching the sounds of each of the game pieces. If the sounds match, the player can uncover the baby farm animal, and retains those game pieces. If the sounds do not match, the player returns the game pieces to the board. The first player to match two pairs of farm animals is the winner.

For use with older children, the object of the game is to match both of the corresponding baby farm animals to the mother farm animal. By increasing the number of baby animals to match, the difficulty of the game is increased, thus making the game playable by older children as well. In this method of game play, if the first baby farm animal matches the mother farm animal, the first baby farm animal is moved to a blank holding receptacle 76 at the rear of the base assembly 46, and the player randomly selects another concealed baby farm animal game piece 28. If the sounds of the second baby farm animal also match, the player can uncover the baby farm animals and retain the three matching game pieces. If the sounds do not match, all of the game pieces are returned to the board, and play passes to the next player. The first player to match two sets of farm animals is the winner.

It can therefore be seen that the present invention provides a unique and amusing electronic matching game which can provide hours of entertainment for young children. The matching pairs of farm animals provides amusing game pieces which young children can easily identify, while the device for generating matching sounds for the game pieces provides the game apparatus with educational value for the children. Furthermore, because the baby farm animals are hidden from view the children must utilize their memory skills to remember the identity of specific game pieces after listening to the corresponding sounds during game play. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A game apparatus comprising:

a plurality of primary game pieces each representative of a different entity;

a plurality of secondary game pieces each representative of an entity which is associated with a respective one of primary game pieces;

means for concealing the identity of each of the secondary game pieces;

a base assembly having a first receptacle adapted to interchangeable receive one of said primary game pieces, and further having a second receptacle adapted to interchangeably receive one of said secondary game pieces;

sound generation means for producing a plurality of sounds, each sound being associated with a respective one of said primary and secondary game pieces; and first and second switch means associated with each of said first and second receptacles and coupled to said sound generating means for causing said sound generating means to produce a sound corresponding to a respective game piece placed on the respective receptacle.

2. The game apparatus of claim 1 wherein each of said primary game pieces comprises a representation of a mother farm animal, and further wherein each of said secondary game pieces comprises a representation of a baby farm animal corresponding to a respective one of said mother farm animals.

3. The game apparatus of claim 2 wherein each of said secondary game pieces comprises a base portion having a representation of a baby farm animal thereon, said means for concealing the identity of said secondary game piece comprising a removable cover portion which is selectively mounted on the base portion to conceal the identity of the secondary game piece.

4. In the game apparatus of claim 2, each of said first and second switch means including a plurality of switches and being actuatable for producing a plurality of different predetermined sounds corresponding to different predetermined game pieces, each of said primary and secondary game pieces including engaging means for selectively engaging the switches of the switch means of the respective receptacle thereof for producing sounds which correspond to the respective game piece in the respective receptacle.

5. The game apparatus of claim 1 wherein said means for concealing the identities of said secondary game pieces comprises removable cover members for selectively covering said secondary game pieces during play.

6. In the game apparatus of claim 5, each of said first and second switch means including a plurality of switches and being actuatable for producing a plurality of different predetermined sounds corresponding to different predetermined game pieces, each of said primary and secondary game pieces including engaging means for selectively engaging the switches of the switch means of the respective receptacle thereof for producing sounds which correspond to the respective game piece in the respective receptacle.

7. The game apparatus of claim 2 wherein said means for concealing the identities of said secondary game pieces comprises removable cover members for selectively covering said secondary game pieces during play.

8. The game apparatus of claim 1 wherein each of said secondary game pieces comprises a base portion representative of an entity which is associated with a respective one of said primary game pieces, said means for concealing the identity of secondary game piece comprising a removable cover portion which is selectively mounted on the base portion to conceal the identity of the secondary game piece.

9. In the game apparatus of claim 8, each of said first and second receptacles including a plurality of switches wherein actuation of a selected switch causes said sound generating means to produce a selected sound, each of said primary and secondary game pieces including an engaging formation thereon for selectively engaging one of said switches, said engaging formation being selectively located on the respective game piece for engaging a respective switch which corresponds to the respective sound for the game piece.

10. In the game apparatus of claim 1, each of said first and second switch means including a plurality of switches and being actuatable for producing a plurality of different predetermined sounds corresponding to different predetermined game pieces, each of said primary and secondary game pieces including engaging means for selectively engaging the switches of the switch means of the respective receptacle thereof for producing sounds which correspond to the respective game piece in the respective receptacle.

11. A method of game play comprising the steps of:

providing a plurality of primary game pieces each representative of a different entity;

providing a plurality of secondary game pieces each representative of an entity which is associated with a respective one of primary game pieces;

concealing the identity of each of the secondary game pieces;

placing one of said primary game pieces into a receptacle on a base assembly wherein said base assembly includes a sound generating device adapted to generate a first sound corresponding to the respective primary game piece when placed in said receptacle;

randomly selecting one of said disguised secondary game pieces;

placing said randomly selected secondary game piece into a receptacle on said base assembly wherein said base assembly includes a sound generating device adapted to generate a second sound corresponding to the respective secondary game piece when placed in said receptacle; and determining if the second sound matches the first sound.

12. The method of game play of claim 11 further comprising the step of returning the primary and secondary game pieces to a play area if the second sound does not match the first sound.

13. The method of game play of claim 12 further comprising the step of uncovering the secondary game piece if the second sound matches the first sound, the player thereafter being able to remove said primary and secondary game pieces from game play.

14. The method of game play of claim 11 further comprising the step of uncovering the secondary game piece if the second sound matches the first sound, the player thereafter being able to remove said primary and secondary game pieces from game play.

15. The method of game play of claim 11 further comprising the steps of:

randomly selecting a second one of said disguised secondary game pieces;

placing said second randomly selected secondary game piece into a receptacle on said base assembly wherein said base assembly includes a sound generating device adapted to generate a third sound corresponding to the second randomly selected secondary game piece when placed in said receptacle; and determining if the third sound matches the first and second sounds.

16. The method of game play of claim 15 further comprising the step of returning the primary and secondary game pieces to a play area if the third sound does not match the first and second sounds.

17. The method of game play of claim 16 further comprising the step of uncovering the selected secondary game pieces if the second and third sounds matches the first sound, the player thereafter being able to remove said primary and secondary game pieces from game play.

18. The method of game play of claim 15 further comprising the step of uncovering the selected secondary game pieces if the second and third sounds matches the first sound, the player thereafter being able to remove said primary and secondary game pieces from game play.

* * * * *